US006159555A

United States Patent [19]

Hahne et al.

[11] Patent Number: 6,159,555

[45] Date of Patent: Dec. 12, 2000

[54] METHOD AND DEVICE FOR ELECTROSTATIC CHARGING

[75] Inventors: Ernst August Hahne, Allschwil, Switzerland; Hermann Kunzig, Weil am Rhein; Franz Knopf, Buhl, both of Germany

[73] Assignee: Eltex-Elektrostatik GmbH, Weil am Rhein, Germany

[21] Appl. No.: 09/142,828

[22] PCT Filed: Nov. 16, 1997

[86] PCT No.: PCT/EP97/06387

§ 371 Date: Aug. 9, 1998

§ 102(e) Date: Aug. 9, 1998

[87] PCT Pub. No.: WO98/43904

PCT Pub. Date: Oct. 8, 1998

[30] Foreign Application Priority Data

Apr. 2, 1997 [DE] Germany ..... 197 13 662

[51] Int. Cl.[7] ..... B05D 1/04; G03G 15/02

[52] U.S. Cl. ..... 427/458; 427/458; 427/471; 427/482; 427/444; 118/620; 118/638

[58] Field of Search ..... 427/458, 471, 427/472, 483, 444, 482; 118/620, 638, 50.1; 361/225, 226

[56] References Cited

U.S. PATENT DOCUMENTS 3,876,917 4/1975 Gaynor et al. .
4,056,314 11/1977 Silverberg .
4,978,118 12/1990 Kashahara .
5,138,971 8/1992 Nakajima et al. .

FOREIGN PATENT DOCUMENTS 2667267 9/1990 France .
2754179 12/1977 Germany .
3117419 4/1982 Germany .
9400931 1/1994 Germany .
29517139 2/1996 Germany .

OTHER PUBLICATIONS

"Static Electricity in Folding Apparatus and in Further Processing" appearing in *Der Polygraph* 11, 1986, pp. 1258, 1260.

*Primary Examiner*—Fred J. Parker
*Attorney, Agent, or Firm*—Antonelli, Terry, Stout & Kraus, LLP

[57] ABSTRACT

The invention relates to a method for electrostatic charging of the two outer sides of at least one material web with charges of opposite polarity, prior to the further processing of the at least one material web, with the web being guided through the nip of a pair of rollers that are parallel to one another and are arranged with a short space between them, characterized in that the electrostatic charging of the two outer sides of the at least one material web is performed by the rollers in the nip between them.

16 Claims, 3 Drawing Sheets

METHOD AND DEVICE FOR ELECTROSTATIC CHARGING

BACKGROUND OF THE INVENTION

1. Field of the Invention

The invention relates to a method as well as a device for electrostatic charging of the two outer sides of at least one material web with charges of opposite polarity, prior to the further processing of the at least one material web wherein the web is guided through the nip of a pair of rollers that are parallel to one another and have a small distance between them.

2. Description of the Prior Art

A method of this kind and a device for electrostatic charging is known (DE 31 17 419 A1). In this document, a plurality of material webs are brought together to form a hank and only the two outer sides are charged by means of a device designed as a corona-charging electrode for electrostatic charging downstream from the first pair of rollers by means of a high voltage source of 30 kV.

The disadvantage of this known device is a charging of the two outer sides of the material webs that is not highly directed in space. Thus, a large number of charged particles migrate throughout the area where charging is taking place. This results in poor charging efficiency. In addition, there is the danger that under unfavorable environmental conditions, the corona charging electrodes will become contaminated and consequently fall to operate. The cleaning expense can be very high.

SUMMARY OF THE INVENTION

The invention is a method providing a more closely directed charging with improved efficiency.

The invention uses the unequal electrostatic charging of the two outer sides of the at least one material web, performed in the nip by each roller of the pair.

The rollers can be charged through the surface, namely by means of a so-called contact roller (DE 38 23 739 A1), or by wiper brushes known of themselves, or by a wiper contact.

In an advantageous improvement according to the invention, charging is performed from the inside by the device composed of the pair of rollers, with each roller having a covering with limited electrical conductivity (so-called semiconducting) on top of a steel jacket, with the steel jacket of each roller being connected to a positive or negative high voltage source for electrical charging of the coating with limited conductivity. In the device according to the invention, because the voltage is applied from the inside, retrofitting in existing systems for processing material webs, preferably made of plastic or paper, using a high voltage source of 3 to 7 kV is possible. Therefore, much lower voltages are used relative to the prior art. In addition, charging takes place precisely at the charged point, namely at the outside of the at least one material web, so that efficiency is achieved that is considerably better by comparison with the prior art. Finally, due to the elimination of corona charging electrodes, their cleaning cost is eliminated completely so that lower downtime expenses are achieved as well as when the system is in operation.

Advantageously, in the invention the axis or shaft of the roller is connected in an electrically conducting fashion with the steel jacket and is insulated electrically from the machine frame supporting the roller. For electrical charging of the coating with limited conductivity, the high electrical voltage is applied to the axis or shaft which has a terminal for this purpose. This could be either a fixed terminal on the axis or a pressure bearing located at the end of the shaft.

In an advantageous improvement on the invention, it is also possible to mount a primary coil permanently relative to the machine frame and concentrically with respect to the axis or shaft of the roller at one end, concentrically with respect to the axis or shaft of the roller and next to the roller, and to provide a secondary coil that turns with the roller, with its one terminal on the axis or shaft and its other terminal connected to the steel jacket through a rectifier circuit.

BRIEF DESCRIPTION OF THE DRAWINGS

Three embodiments of the invention will be described in greater detail below with reference to the drawing.

DESCRIPTION OF THE PREFERRED EMBODIMENTS

Figure 1:
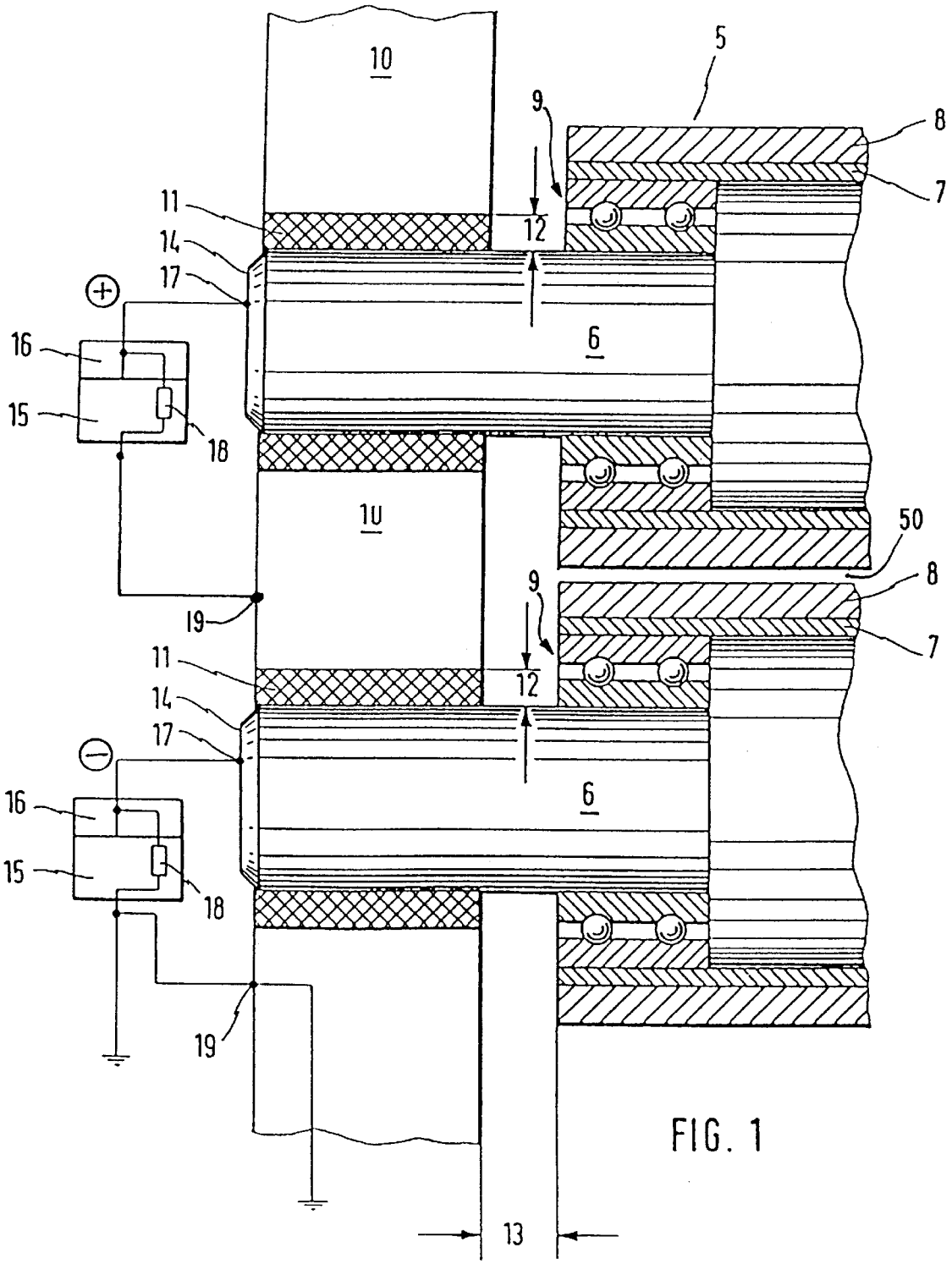
FIG. 1 is a first embodiment of the device according to the invention in a schematic cross section and partially broken away.

Each of the two rollers 5 in FIG. 1 has a fixed axis 6 as well as a steel jacket 7, on top of which is a coating 8 which has limited conductivity that can be charged electrically. Between axis 6 and steel jacket 7, a ball bearing 9 is provided. A nip 50 is provided between the two rollers at which opposed surfaces of webs of material are charged by contact with two rollers that are mounted parallel to one another.

The axis of roller 5 is mounted in a machine stand 10, in electrical insulation 11. Spaces 12 and 13 are sufficient to prevent discharges or voltage sparkovers.

The end of axis 6 is connected to a generator 15, and a measuring device 16 with a terminal 17, with the lead running to terminal 17 being grounded through a resistance 18. Machine stand 10 is likewise grounded, as shown schematically by 19.

Figure 2:
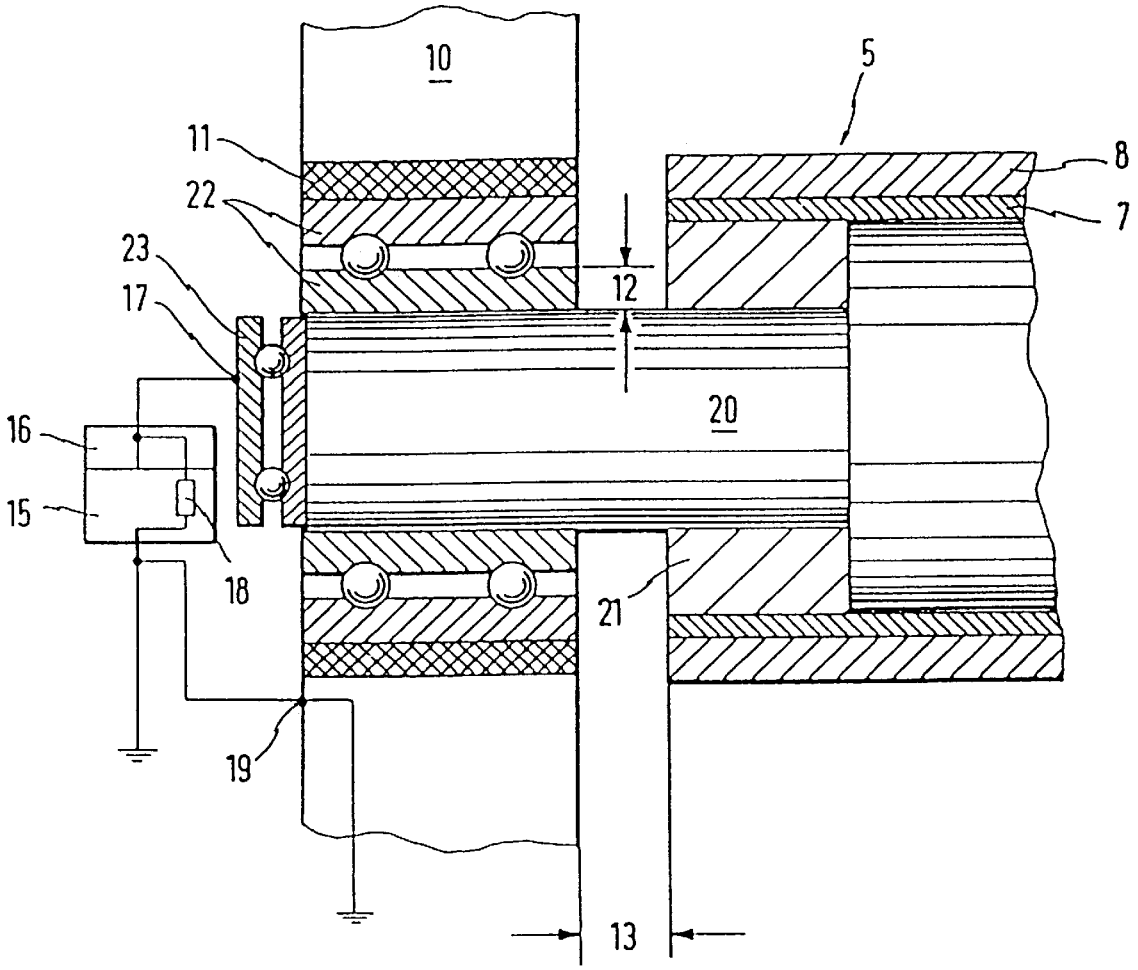
FIG. 2 is a second embodiment of the device according to the invention in a schematic cross section and a simplified partially broken-away view.

The embodiment according to FIG. 2 differs from that in FIG. 1 in that only one of the two rollers is shown and axis is designed 20 which is connected rigidly through an electrically conducting intermediate piece 21 with steel jacket 7.

For this purpose, shaft 20 of machine stand 10 is connected either through an electrically insulating ball bearing 22 or separate insulation 11. It is also possible to use a normal electrically conducting ball bearing and to provide an electrically insulating sleeve 11 between the latter and machine stand 10.

In addition, a pressure bearing 23 is provided as a terminal at end 14 of shaft 20, said terminal being electrically conducting and to whose exterior the terminal 17 of high-voltage generator 15 is connected through measuring device 16.

In both embodiments according to FIGS. 1 and 2, assurance is provided that the high voltage applied through axis 6 or shaft 20 cannot be connected to machine stand 10 because of electrical insulation 11 and the high voltage on coating 8 with limited conductivity of roller 5 can pass from the inside to the outside.

Figure 3:
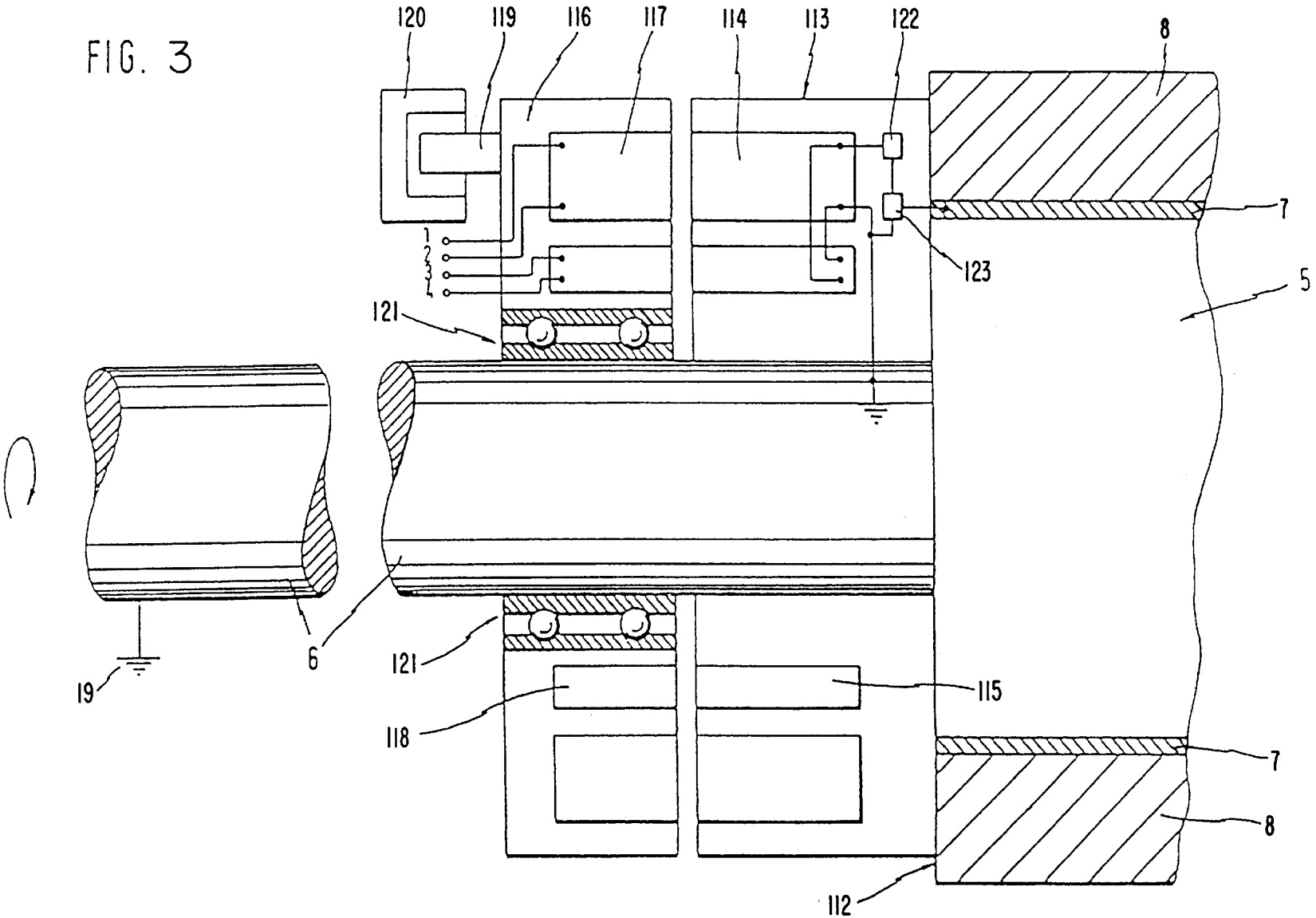
FIG. 3 is a third embodiment of the device according to the invention in a partially broken-away and simplified broken-away view.

The additional, third embodiment shown in FIG. 3 likewise has two rollers forming a nip, however only one roller is shown for reasons of improved clarity, that is like the one shown in FIGS. 1 and 2. In addition, concentrically to shaft 6 of roller 5, and in addition to the latter, a first receiving device 113 is provided at one end 112 as a magnetizable core with a secondary coil 114 and a second secondary coil 115, each concentric to shaft 6.

An additional receiving device 116 is provided concentrically with respect to shaft 6 as a magnetizable core for receiving a primary coil 117, likewise concentric with respect to shaft 6, with electrical terminals 1 and 2 as well as a second primary coil, with electrical terminals 3 and 4 located between primary coil 117 and shaft 6. Receiving device 16 is rotatable relative to shaft 6 by means of a pin that engages an anchor 120 that is fixed relative to the machine frame, and has on its interior a ball bearing designated as a whole by 121, so that the device can turn but the magnetizable core is held nonrotatably relative to first receiving device 113 by pin 119 and anchor 120.

On the secondary side of first receiving device 113, a rectifier circuit 122 and a smoothing circuit 123 are also provided, with circuit 123 having its output connected to coating 8 with limited conductivity.

The electrical terminal 2 of primary coil 117 is grounded, while electrical terminal 1 can be connected to an AC generator. The two electrical terminals 3 and 4 of second primary coil 118 can be connected to the inputs of a regulating circuit, which can change the value of the output voltage and/or its frequency in a known manner.

Secondary coil 114 is grounded on one side. The same also applies to second secondary coil 115. The two secondary coils 114 and 115 are wired in parallel. Both coils are followed downstream first by rectifier circuit 122 for rectifying the alternative current. Downstream from rectifier circuit 122 is smoothing circuit 123, in the form of a known LC filter. The output of smoothing circuit 123 is connected with coating 8 with limited conductivity on roller 5.

During operation, secondary coil 114 moves relative to primary coil 117. Therefore the alternating voltage of primary coil 117 can induce a secondary voltage in secondary coil 114 through the air gap between the two magnetizable cores of receiving devices 113 and 116, said secondary voltage being supplied directly to coating 8 with limited conductivity after being rectified by rectifier circuit 122 and smoothed by smoothing circuit 123. The voltage induced in secondary coil 114 is tapped off by second secondary coil 115 and is induced in the opposite direction in second primary coil 118, which can be connected by its electrical terminals 3 and 4 to a regulating circuit that can control the AC voltage source in such fashion that the same DC voltage is always applied to coating 8 with limited conductivity on roller 5.

What is claimed is:

1. A method of electrostatic charging of opposite sides of an at least one material web with charges of opposite polarity comprising:

moving the at least one material web through a nip between a pair of parallel rotatable rollers having an outer semiconductive layer defining the nip which contacts the opposite sides of the at least one material web; and charging the opposite sides of the at least one material web with opposite polarities by conduction from a voltage source having opposite polarities to provide the opposite polarities respectively, through the rollers to the outer semiconductive layers by rolling contact during moving of the at least one material web through the nip.

2. A method according to claim 1, wherein:

the rollers are pressed against the opposite sides of the at least one material web with an adjustable force.

3. A device for electrostatic charging of opposite sides of at least one material web with charges of opposite polarity comprising:

a pair of rotatable parallel conductive rollers;

a semiconductive outer layer disposed on each conductive roller;

a nip disposed between the outer layers of the rollers with the at least one material web moving through the nip with opposite sides of the at least one material web being in contact respectively with the outer layer of a different one of the pair of rollers; and a voltage source in electrical contact with the rollers which provides by conduction charges of the opposite polarity to the conductive rollers to charge the opposite sides of the at least one material web with different polarity during rolling contact through the nip of the outer layers with the opposite sides of the at least one material web.

4. A device according to claim 3, wherein:

the rollers have an axis disposed in a machine frame; and the axis is connected electrically conductively to the conductive rollers and is electrically insulated from the machine frame.

5. A device according to claim 4, wherein:

an electrical voltage from the voltage source is applied to a pressure bearing located at an end of the axis.

6. A device according to claim 4, further comprising:

a primary coil mounted concentrically with respect to the axis; and a secondary coil attached concentrically to the axis at one end thereof and turning therewith, and the secondary coil is electrically connected to the axis and through a rectifier circuit to the semiconductive outer layer.

7. A device according to claim 6, further comprising:

a smoothing circuit for smoothing a pulsating DC current produced by the secondary coil which is electrically coupled to the rectifier circuit and the semiconductive outer layer.

8. A device according to claim 6, wherein:

the primary coil comprises two primary coils and the secondary coil comprises two secondary parallel connected coils, one of the two secondary parallel connected coils being rotatable and located opposite one of the two primary coils.

9. A device according to claim 7, wherein:

the primary coil comprises two primary coils and the secondary coil comprises two parallel connected secondary coils, one of the secondary coils being located opposite one of the primary coils.

10. A device according to claim 3, wherein:

spacing between the nip is adjustable.

11. A device according to claim 4, wherein:

spacing between the nip is adjustable.

12. A device according to claim 5, wherein:

spacing between the nip is adjustable.

13. A device according to claim 6, wherein:

spacing between the nip is adjustable.

14. A device according to claim 7, wherein: spacing between the nip is adjustable.

15. A device according to claim 8, wherein: spacing between the nip is adjustable.

16. A device according to claim 9, wherein: spacing between the nip is adjustable.

* * * * *